US008007600B2

(12) United States Patent
Ohta et al.

(10) Patent No.: US 8,007,600 B2
(45) Date of Patent: Aug. 30, 2011

(54) SOFT MAGNETIC THIN STRIP, PROCESS FOR PRODUCTION OF THE SAME, MAGNETIC PARTS, AND AMORPHOUS THIN STRIP

(75) Inventors: Motoki Ohta, Kumagaya (JP); Yoshihito Yoshizawa, Kumagaya (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 12/596,912

(22) PCT Filed: Apr. 24, 2008

(86) PCT No.: PCT/JP2008/057969

§ 371 (c)(1), (2), (4) Date: Oct. 21, 2009

(87) PCT Pub. No.: WO2008/133302

PCT Pub. Date: Nov. 6, 2008

(65) Prior Publication Data

US 2010/0084056 A1 Apr. 8, 2010

(30) Foreign Application Priority Data

Apr. 25, 2007 (JP) ..... 2007-115562

(51) Int. Cl.
*H01F 1/153* (2006.01)

(52) U.S. Cl. ..... 148/121; 148/304; 148/305; 148/403

(58) Field of Classification Search ..... None
See application file for complete search history.

(56) References Cited

U.S. PATENT DOCUMENTS

| | | | | |
|---|---|---|---|---|
| 5,160,379 | A | * | 11/1992 | Yoshizawa et al. ..... 148/108 |
| 5,522,948 | A | * | 6/1996 | Sawa et al. ..... 148/308 |

FOREIGN PATENT DOCUMENTS

| | | | | |
|---|---|---|---|---|
| EP | 1925686 | A1 | | 5/2008 |
| JP | 01-156451 | A | | 6/1989 |
| JP | 05-017819 | A | | 1/1993 |
| JP | 05-140703 | A | | 6/1993 |
| JP | 05-263197 | A | | 10/1993 |
| JP | 06-017204 | | * | 1/1994 |
| JP | 2004-353090 | | * | 12/2004 |
| JP | 2006-040906 | A | | 2/2006 |
| WO | 2007/032531 | A1 | | 3/2007 |

OTHER PUBLICATIONS

Translation of Japanese Patent Document No. 06-017204.*
Translation of Japanese Patent Document No. 2004-353090.*
Translation of Japanese Patent Document No. 05-263197.*
Translation of Japanese Patent Document No. 2006-040906.*

* cited by examiner

*Primary Examiner* — John P Sheehan
(74) *Attorney, Agent, or Firm* — Sughrue Mion, PLLC

(57) ABSTRACT

The invention provides a soft magnetic thin strip which contains nanoscale fine grains and exhibits a high saturation magnetic flux density and excellent soft magnetic characteristics; a process for production of the same; magnetic parts; and an amorphous thin strip to be used in the production. In the invention, an amorphous thin strip is used, which is represented by the composition formula: $Fe_{100-x-y-z}A_xM_yX_{z-a}P_a$ (wherein A is at least one element selected from between Cu and Au; M is at least one element selected from among Ti, Zr, Hf, V, Nb, Ta, Cr, Mo, W and Mn; X is at least one element selected from between B and Si; and x, y, z and a (in terms of atomic percentage) satisfy the relationships: $0.5 \leqq x \leqq 1.5$, $0 \leqq y \leqq 2.5$, $10 \leqq z \leqq 23$, and $0.35 \leqq a \leqq 10$ respectively) and permits 180° bending. The amorphous thin strip can give through anneal a soft magnetic thin strip having a structure wherein grains of body-centered cubic structure having an average grain size of 60 nm or below are distributed in an amorphous phase with a grain volume fraction of 30% or above.

12 Claims, No Drawings

SOFT MAGNETIC THIN STRIP, PROCESS FOR PRODUCTION OF THE SAME, MAGNETIC PARTS, AND AMORPHOUS THIN STRIP

CROSS REFERENCE TO RELATED APPLICATION

This application is a National Stage of International Application No. PCT/JP2008/057969 filed Apr. 24, 2008, claiming priority based on Japanese Patent Application No. 2007-115562, filed Apr. 25, 2007, the contents of all of which are incorporated herein by reference in their entirety.

TECHNICAL FIELD

The present invention relates to a soft magnetic thin ribbon having a high saturation magnetic flux density and excellent soft magnetic properties, especially excellent alternating-current (AC) magnetic properties, that has nano-scale fine crystalline grains and is used in various transformers, reactor choke coils, noise suppression parts, laser power supplies, pulse-power magnetic parts for use in accelerators and the like, communications pulse transformers, motor cores, generators, magnetic sensors, antenna cores, current sensors, magnetic shields, electromagnetic wave absorbing sheets, yoke materials, and the like. The present invention also relates to a method for producing the soft magnetic thin ribbon and a magnetic part. The present invention further relates to an amorphous thin ribbon used in producing the soft magnetic thin ribbon.

BACKGROUND ART

A Silicon steel, ferrite, amorphous alloy, Fe-based nanocrystalline alloy material and the like have been known as magnetic materials having a high saturation magnetic flux density and excellent AC magnetic properties, that are used in various transformers, reactor choke coils, noise suppression parts, laser power supplies, pulse-power magnetic parts for accelerators, various motors, various generators and the like.

While a silicon steel plate is manufactured from an inexpensive material and has a high magnetic flux density, there is a problem of high core loss in high-frequency applications. It is extremely difficult to process these materials as thin as amorphous thin ribbons because of its production process. Further, it has a high eddy-current loss and thus a high loss associated therewith. Thus, it is disadvantageous. In addition, a ferrite has a low saturation magnetic flux density and poor temperature properties. Thus, the ferrite is not suitable for high-power applications where a high operational magnetic flux density is applied, since it easily magnetically saturates.

A Co-based amorphous alloy has a problem of thermal instability since its saturation magnetic flux density is as low as 1 T or less for its practical material. This causes some problems that a part becomes large and a core loss increases due to changes with ages when it is used in high-power applications. Moreover, there is an economical problem since Co also is expensive.

A Fe-based amorphous soft magnetic alloy as described in JP-A-5-140703 has very good soft magnetic properties, since it has a good squareness property and a low coercive force. However, the saturation magnetic flux density of the Fe-based amorphous soft magnetic alloy is determined by balancing between the atomic distance and the coordination number and Fe concentration, and thus a physical upper limit thereof is about 1.65 T. In addition, the Fe-based amorphous soft magnetic alloy has problems that its property is deteriorated due to a stress since it has high magnetostriction, and that it causes high noise in applications where currents in the audible frequency range are superposed. Moreover, If Fe is significantly substituted with other magnetic element such as Co or Ni, a slight increase in saturation magnetic flux density is also found in a conventional Fe-based amorphous soft magnetic alloys. However, the amount (percent by weight) of the element is desirably minimized in terms of cost. Because of these problems, a soft magnetic material having nano-crystal, as described in JP-A-1-156451, has been developed and used in various applications.

As a soft magnetic compact having a high magnetic permeability and a high saturation magnetic flux density, a technique as described in JP-A-2006-40906 has also been disclosed but its saturation magnetic flux density has not yet reached 1.7 T. Thus, a magnetic alloy having a saturation magnetic flux density equal to or greater than that value is demanded.

PATENT DOCUMENT 1: JP-A-5-140703
PATENT DOCUMENT 2: JP-A-1-156451
PATENT DOCUMENT 3: JP-A-2006-40906

DISCLOSURE OF THE INVENTION

Problems to be Solved by the Invention

An object of the present invention is to provide a soft magnetic thin ribbon having a high saturation magnetic flux density and a low coercive force, that is inexpensive since it does not substantially contain Co, that has a high saturation magnetic flux density, while not essential, of not lower than 1.7 T, and that has improved toughness and production stability which are included in the above problems. It also provides a process for producing the soft magnetic thin ribbon; and a magnetic part that uses the soft magnetic thin ribbon. In addition, another object of the present invention is to provide an amorphous thin ribbon used in producing the soft magnetic thin ribbon.

Means for Solving the Problems

The present invention provides a method for producing a soft magnetic thin ribbon, comprising the steps of:

casting an alloy melt whose composition formula is represented by $Fe_{100-x-y-z}A_xM_yX_{z-a}P_a$, where A represents at least one element selected from Cu and Au; M represents at least one element selected from Ti, Zr, Hf, V, Nb, Ta, Cr, Mo, and W; X represents at least one element selected from B and Si; and $0.5 \leqq x \leqq 1.5$, $0 \leqq y \leqq 2.5$, $10 \leqq z \leqq 23$, and $0.35 \leqq a \leqq 10$ in atomic percent, to obtain a substantially amorphous thin ribbon having a thickness of not greater than 100 μm; and then annealing the amorphous thin ribbon at an average heating rate of not less than 100° C./min in the temperature range of not lower than 300° C., to obtain a soft magnetic thin ribbon having a structure where crystalline grains having a size of not greater than 60 nm (excluding 0) are dispersed at a volume fraction of not less than 30% in an amorphous phase.

According to an embodiment of the present invention, a method for producing a soft magnetic thin ribbon comprises the step of:

casting a molten alloy whose composition formula is represented by $Fe_{100-x-z}A_xX_{z-a}P_a$, where A represents at least one element selected from Cu and Au; X represents at least one element selected from B and Si; and $0.5 \leqq x \leqq 1.5$, $10 \leqq z \leqq 23$, and 0.35≦a≦10 in atomic percent, to obtain a practically amorphous thin ribbon having a thickness of not greater than 100 μm; and then annealing the amorphous thin ribbon at an average heating rate of not less than 100° C./min in a temperature range of not lower than 300° C., to obtain a soft magnetic thin ribbon having a structure where crystalline grains having a size of not larger than 60 nm (excluding 0) are dispersed at a volume fraction of not less than 30% in an amorphous phase.

In addition, the present invention uses an amorphous thin ribbon that is substantially amorphous and can be bent at 180 degrees, whose composition formula is represented by $Fe_{100-x-y-z}A_xM_yX_{z-a}P_a$, where A represents at least one element selected from Cu and Au; M represents at least one element selected from Ti, Zr, Hf, V, Nb, Ta, Cr, Mo, and W; X represents at least one element selected from B and Si; and 0.5≦x≦1.5, 0≦y≦2.5, 10≦z≦23, and 0.35≦a≦10 in atomic percent.

An embodiment of the present invention uses an amorphous thin ribbon that is substantially amorphous and can be bent at 180 degrees, whose composition formula is represented by $Fe_{100-x-z}A_xX_{z-a}P_a$, where A represents at least one element selected from Cu and Au; X represents at least one element selected from B and Si; and 0.5≦x≦1.5, 10≦z≦23, and 0.35≦a≦10 in atomic percent.

The "A" preferably involves Cu as an essential element.

According to one embodiment of the invention, an amorphous thin ribbon can be used that contains at least one element selected from Ni and Co in an amount of less than 10 at % relative to the Fe content, and/or at least one element selected from Re, the platinum group elements, Ag, Zn, In, Sn, As, Sb, Bi, Y, N, O, Mn, and the rare earth elements in an amount of less than 5 at % relative to the Fe content.

An amorphous thin ribbon can be used that contains at least one element selected from Be, Ga, Ge, C and Al in an amount of less than 5 at % relative to the X content.

By an anneal of an amorphous thin ribbon, can be obtained a soft magnetic thin ribbon made from an Fe-based alloy containing Fe and a metalloid element, that has a structure where body-centered cubic (bcc) structural crystalline grains having an average particle size of not greater than 60 nm are dispersed at a volume fraction of not less than 30% in the amorphous phase.

The soft magnetic thin ribbon of the present invention including the fine crystalline grains can have high magnetic properties such as saturation magnetic flux density of not lower than 1.7 T and coercive force of not higher than 20 A/m.

The soft magnetic thin ribbon can be used to produce a magnetic part.

Advantages of the Invention

According to the present invention, a soft magnetic thin ribbon having a high saturation magnetic flux density, excellent magnetic properties, particularly excellent low-loss properties can be provided at low cost. It is used in various reactors for high current, choke coils for active filters, smoothing choke coils, various transformers, noise suppression parts such as electromagnetic shielding materials, laser power supplies, pulse-power magnetic parts for accelerators, motors, generators or the like.

In addition, the amorphous thin ribbon of the present invention in an amorphous state has high flexural strength and can be easily handled during production thereof.

In addition, anneal of the amorphous thin ribbon of the present invention at high temperature for a short period of time can inhibit the growth of crystalline grains and provide a low coercive force and an improved magnetic flux density in a low magnetic field, and a reduced hysteresis loss. Such anneal can provide a high magnetic property generally required, and thus is preferred.

Use of this soft magnetic thin ribbon can realize high-performance magnetic parts and is remarkably effective.

BEST MODE FOR CARRYING OUT THE INVENTION

The present invention aims to balance a soft magnetism and a high saturation magnetic flux density $B_S$ (desirably not lower than 1.7 T) in an alloy having a high Fe content, and attempted to develop a fine crystalline material with a focus on the Fe—P binary system and the Fe-M-P ternary system (where M represents at least one element selected from Ti, Zr, Hf, V, Nb, Ta, Cr, Mo, and W) that can stably have an amorphous phase even at a high Fe content. Specifically, Cu is added to an alloy having an Fe content of not more than 88% (at %), of which a thin ribbon with an amorphous phase as the main phase can be stably obtained, since Cu does not solid solutes with Fe. Thus, nucleus of fine crystals is generated and then it is annealed to precipitate fine crystals and grow the crystalline grains to obtain a fine crystalline material. The formation of an amorphous phase at the early stage of alloy production can provide uniform fine crystalline grains. To obtain $B_S$ of not lower than 1.7 T by using the soft magnetic fine crystalline alloy of the present invention, the Fe content is desirably at least about 75% (at %) if the entire structure is composed of fine crystals of bcc Fe.

The soft magnetic thin ribbon having a high saturation magnetic flux density and a low coercive force according to the present invention invented by the above study is represented by the composition formula $Fe_{100-x-z}A_xX_{z-a}P_a$ (where A represents at least one element selected from Cu and Au; X represents at least one element selected from B and Si; and 0.5≦x≦1.5, 10≦z≦23, and 0.35≦a≦10 in atomic percent), or the composition formula $Fe_{100-x-y-z}A_xX_{z-a}P_a$ (where A represents at least one element selected from Cu and Au; M represents at least one element selected from Ti, Zr, Hf, V, Nb, Ta, Cr, Mo, and W; X represents at least one element selected from B and Si; and 0.5≦x≦1.5, 0<y≦2.5, 10≦z≦23, and 0.35≦a≦10 in atomic percent). The soft magnetic thin ribbon in an amorphous state after rapid cooling has a high flexural strength and can be bent at 180 degrees. In addition, the structured soft magnetic thin ribbon having mainly fine crystalline grains after anneal can have high magnetic properties.

In the range specified by 0.5≦x≦1.5, y≦2.0, 10≦z≦20, and 0.35≦a≦10 within the compositional ranges, the saturation magnetic flux density of not lower than 1.74 T is obtained and thus such a soft magnetic thin ribbon is desirable as a soft magnetic material.

Moreover, in the range specified by 0.5≦x≦1.5, y≦1.5, 10≦z≦18, and 0.35≦a≦10 within the compositional ranges, the saturation magnetic flux density of not lower than 1.78 T is obtained and thus such a soft magnetic thin ribbon is more desirable as a soft magnetic material.

Furthermore, in the range specified by 0.5≦x≦1.5, y≦1.0, 10≦z≦16, and 0.35≦a≦10 within the compositional ranges, the saturation magnetic flux density of not lower than 1.8 T is obtained and thus such a soft magnetic thin ribbon is extremely desirable as a soft magnetic material.

The content x of the element A, which is Cu or Au, is defined to be 0.5≦x≦1.5. If the content of A exceeds 1.5%, a thin ribbon with an amorphous phase as the main phase embrittles during rapid cooling in liquid. The content of A is more preferably to be 0.7≦x≦1.3. The use of Cu as the element A is preferable in terms of cost, and if Au is used, its content is preferably in the range of not more than 1.5 at % relative to the Cu content.

In addition, the content y of the element M (M is at least one element selected from Ti, Zr, Hf, V, Nb, Ta, Cr, Mo, and W) is defined to be $y \leqq 2.5$. If the content of M exceeds 2.5%, the saturation magnetic flux density is less than 1.7 T.

If the total content z of the element X (X is at least one element selected from B and Si) and P is less than 10%, it is extremely difficult to obtain a thin ribbon with an amorphous phase as the main phase. If the content z exceeds 20%, on the contrary, the saturation magnetic flux density is not higher than 1.7 T. In addition, an amorphous phase can stably be obtained while the restrictions on the Fe content are satisfied.

The content x of the element A, the content y of the element M, and the total content z of the element X and P are more preferably to be, respectively, $0.7 \leqq x \leqq 1.3$, $y \leqq 1.5$, and $12 \leqq z \leqq 20$, and much more preferably $0.7 \leqq x \leqq 1.3$, $y \leqq 1.0$, and $12 \leqq z \leqq 16$. By controlling x, y and z in these ranges, a soft magnetic fine crystalline alloy having a high saturation magnetic flux density and a low coercive force of not more than 12 A/m is obtained.

P is an element that is extremely effective in improving the formability of an amorphous phase and also effective in inhibiting the growth of nano-crystalline grains. For these reasons, P is an element that is essential for realization of high toughness, high $B_S$, and good soft magnetic properties, which the present invention intends.

B is an element that is useful for accelerating the formation of the amorphous phase.

Addition of Si increases the precipitate starting temperature of Fe—P and Fe—B that have high magnetocrystalline anisotropy, and thus can make the anneal temperature higher. High-temperature anneal increases the percentage of the fine crystalline phase, increases $B_S$, and improves the squareness of the B—H curve. In addition, it is effective in inhibiting the quality change and discoloration of the sample surface.

M is at least one element selected from Ti, Zr, Hf, V, Nb, Ta, Cr, Mo and W. Along with the element A and metalloid elements, it preferentially enters the amorphous phase that remains even after anneal, so that it acts to inhibit the growth of the fine crystalline grains having a high Fe concentration. This action decreases the average grain size of the nano-crystals and contributes to improve the saturation of the B—H curve and soft magnetic properties. On the other hand, Fe is substantially contributes to the magnetism of the alloy of the present invention, and thus the content of Fe needs to be maintained high. An element having a high atomic weight results in a decrease in the Fe content per unit weight. Especially, if Nb or Zr is a substituting element, the amount of substitution is about not more than 2.5% and more preferably not more than 1.5%. If Ta or Hf is a substituting element, the amount of substitution is not more than 1.5% and more preferably not more than 0.8%. In addition, even if a part of Fe is substituted with at least one element selected from Re, the platinum group elements, Ag, Zn, In, Sn, As, Sb, Bi, Y, N, O, Mn and the rare earth elements, the above effects can be also obtained. Substitution with Mn decreases the saturation magnetic flux density, so that the amount of substitution is preferably less than 5% and more preferably less than 2%.

An total amount of these elements is preferably not more than 1.5 at % in order to obtain a particularly high saturation magnetic flux density. In addition, the total amount is more preferably not more than 1.0 at %.

A part of X may be substituted with at least one element selected from Ga, Ge, C and Al. Substitution with the element can adjust the magnetostriction and magnetic properties.

By substituting a part of Fe with at least one element selected from Ni and Co that solid solute with Fe and the element A, the formability of an amorphous phase increases, and thus the content of the element A can be increased. The increase in the content of the element A facilitates forming of finer crystalline structure and improves the soft magnetic properties. In addition, substitution with Ni or Co increases the saturation magnetic flux density. More substitution with the element leads to an increase in cost, which is a concern. Thus, the amount of substitution with Ni is less than 10%, preferably less than 5%, and more preferably less than 2%, whereas the amount of substitution with Co is less than 10%, preferably less than 2%, and more preferably less than 1%.

While an amorphous alloy having the same composition as the alloy of the present invention has a relatively high magnetostriction due to the magnetovolume effect, body-centered cubic Fe provides a low magnetovolume effect and thus a much lower magnetostriction. The alloy of the present invention having fine crystalline grains, most of the structure of which is composed mainly of bcc-Fe, holds promise even in view of noise reduction.

A Fe-based alloy has a higher toughness by producing it so as to have a structure where crystalline grains having an average grain size of not greater than 30 nm are dispersed at a volume fraction of less than 10% in the amorphous phase when an alloy melt is rapidly cooled. The volume fraction of the crystalline grains is preferably not more than 5% and more preferably not more than 1%. If fine crystals are distributed at a volume fraction of not less than 10% in the amorphous matrix (excluding the range within 0.2 μm below the thin ribbon surface), the alloy has a lower toughness, and the average grain size, grain size distribution, and grain density of the nano-crystalline phase obtained after anneal are easily affected by a thickness and production conditions, making it difficult to obtain a soft magnetic thin ribbon having stable properties. Reducing fine crystals in the amorphous matrix and facilitating uniform nucleation during anneal solve the above problems.

In the nano-crystalline alloy after anneal, the body-centered cubic structural crystal grains dispersed in the amorphous phase need to have an average grain size of not more than 60 nm and to be dispersed at a volume fraction of not less than 30%. If the average grain size of the crystalline grains exceeds 60 nm, the soft magnetic properties deteriorate, whereas if the volume fraction of the crystalline grains is less than 30%, the percentage of the amorphous phase is so large that a high saturation magnetic flux density cannot be easily obtained. The average grain size of the crystalline grains after anneal is more preferably not more than 30 nm, and the volume fraction of the crystalline grains is more preferably not less than 50%. These ranges allow the realization of an alloy having better soft magnetism and a lower magnetostriction than that of the Fe-based amorphous soft magnetic thin ribbon.

A method of rapidly cooling a melt in the present invention includes a single-roll process, a twin-roll process, an in-rotating liquid spinning process, a gas atomization process, and a water atomization process and the like. Thereby, a flake, a thin ribbon and a powder can be produced. In addition, the temperature of the melt before rapid cooling is desirably about 50° C. to 300° C. higher than the melting point of the alloy.

If no active metal is contained, very rapid cooling processes such as a single-roll process can be performed in air or in a localized atmosphere of argon or nitrogen gas or the like. If an active metal is contained, it is performed in an inert gas such as Ar or He, in a nitrogen gas, under reduced pressure, or in an gas atmosphere which is controlled near the roll surface close to the nozzle tip. In addition, an alloy thin ribbon is produced while $CO_2$ gas is blown against the roll or while CO gas is burned near the roll surface close to the nozzle.

The peripheral speed of a cooling roll in a single-roll process is desirably about 15 m/s to 50 m/s, and the cooling roll is suitably made of pure copper or copper alloys such as Cu—Be, Cu—Cr, Cu—Zr or Cu—Zr—Cr that have good thermal conduction. If a thin ribbon is mass produced or if a thick or wide thin ribbon is produced, the cooling roll preferably has a water-cooling structure.

Through the anneal, a fine crystalline structure can be precipitated in a soft magnetic thin ribbon of the present invention. During heating in the anneal, uniform nucleus is generated and then the soft magnetic thin ribbon is kept in a temperature range equal to or greater than the crystallization temperature for one second or longer in order to facilitate the growth of crystalline grains. Adjustment of the three parameters of heating rate, temperature and time can control nucleation and the growth of crystalline grains. For this reason, even the anneal is performed at high-temperature, the growth of crystalline grains can be inhibited if the anneal time is very short, and it is also effective in reducing the production of compounds, decreasing the coercive force, increasing the magnetic flux density in a low magnetic field, and decreasing the hysteresis loss. The low-temperature long-term anneal mentioned earlier or the above high-temperature short-term anneal can be appropriately used depending on desired magnetic properties. This high-temperature short-term anneal is preferable since generally required magnetic properties can be easily obtained.

The holding temperature is preferably not lower than 430° C. When a temperature is lower than 430° C., the above effect is not easily obtained even by adjusting the holding time appropriately. The holding temperature is preferably $T_{X2}-50°$ C. or higher where $T_{X2}$ is the temperature at which a compound precipitates.

In addition, when a holding time is not shorter than 1 hour, the above effect is not easily obtained and it leads to a longer treatment time and thus poor productivity. The holding time is preferably not longer than 30 minutes, more preferably not longer than 20 minutes, and much more preferably not longer than 15 minutes.

The maximum heating rate is preferably not less than 100° C./min. In addition, the average heating rate is more preferably not less than 100° C./min.

In this production process, a heating rate in the high temperature range greatly affects the properties. Thus, the average heating rate is preferably not less than 100° C./min at an anneal temperature of not lower than 300° C., and more preferably not less than 100° C./min at an anneal temperature of not lower than 350° C.

As a method of performing the heating, a sample may be prepared to have a adjusted weight so as to have a lower heat capacity and be put in a furnace at a temperature equal to or greater than the target temperature in advance. Other methods include a method which uses a lamp heating (infrared concentrating) furnace, a method which directly passes current through a sample to heat the sample with the Joule heat, a method involving heating by electromagnetic induction, a method involving laser heating, and a method which brings a sample into contact with or close to a substance having a high heat capacity to heat the sample. Any of these methods can improve the productivity with continuous anneal.

In addition, nucleation can also be controlled, for example by a multistage anneal involving retention for a certain period of time at a number of stages by changing the heating rate control or varying the temperature. In addition, the alloy may be retained at a temperature less than the crystallization temperature for a certain period of time enough to generate nucleation, followed by anneal at a temperature greater than the crystallization temperature for less than 1 hour to grow crystalline grains. In the case, the crystalline grains inhibit the growth of each other, and thus a uniform, fine crystalline structure is obtained. For example, anneal at about 250° C. for not shorter than 1 hour followed by high-temperature short-term anneal, e.g. involving the condition of a heating rate of not less than 100° C./min when the anneal temperature exceeds 300° C. can provide the same effect as the above production process.

By setting the temperature inside the furnace high, the heating rate is ensured to be high in the high temperature range of not lower than 300° C. and further not lower than 400° C. Even if the temperature of an alloy thin ribbon fails to reach the temperature inside the furnace, the anneal may be finished just after it reaches the target temperature. Thereby, a soft magnetic thin ribbon can have a high $B_S$ and a low coercive force. The target temperature is preferably a temperature greater than the crystallization temperature, and the thin ribbon is preferably placed in the range of temperature greater than the crystallization temperature for not shorter than 1 second.

While anneal can be performed in air, in vacuum, or in an inert gas such as argon, nitrogen, or helium, it is particularly desirably to perform in the inert gas. The anneal increases the volume fraction of crystalline grains mainly of body-centered cubic Fe and increases the saturation magnetic flux density. In addition, the anneal also reduces the magnetostriction. Anneal in a magnetic field can impart induced magnetic anisotropy to the soft magnetic alloy of the present invention. For at least a part of the anneal period, a magnetic field strong enough to saturate the alloy is applied. In general, depending on the shape of the magnetic alloy core, a magnetic field is applied at not less than 8 $kAm^{-1}$ when it is applied along the width direction (the direction of the height of the core in the case of a ring-shaped magnetic core) of the thin ribbon, and at not less than 80 $Am^{-1}$ when it is applied along the longitudinal direction (the direction of the magnetic path of the core in the case of a ring-shaped magnetic core). The magnetic field to be applied may be DC, AC, or repetitively pulsed. A magnetic field is usually applied in the temperature range of not lower than 200° C. for not shorter than 20 minutes. When the magnetic field is applied even during heating, holding at a constant temperature and cooling, better uni-axial magnetic anisotropy is induced, so that a more desirable DC or AC hysteresis loop shape is realized.

An anneal in a magnetic field provides an alloy that has a DC hysteresis loop having a high squareness ratio or a low squareness ratio. If the anneal in a magnetic field is not applied, an alloy of the present invention has a DC hysteresis loop having a moderate squareness ratio. Usually, the anneal is desirable to be performed in an atmosphere of an inert gas having a dew point of not higher than −30° C. Anneal in an atmosphere of an inert gas having a dew point of not higher than −60° C. provides much less variation and a more preferable result.

A more preferable result is obtained when a surface of the soft magnetic thin ribbon of the present invention is, for example, covered with a powder or a film of $SiO_2$, MgO, $Al_2O_3$ or the like; is chemically treated to form an insulating layer thereon; or is subjected to anodic oxidation to form an oxide insulating layer thereon for interlayer insulation, as needed. Such treatments are particularly effective in reducing the impact of eddy current caused by high frequencies propagating across layers and thus improving high-frequency core loss. This effect is particularly remarkable if such treatments are used for a magnetic core composed of a wide thin ribbon with a good surface condition. Moreover, when a magnetic core is produced from the soft magnetic thin ribbon of the present invention, impregnation or coating, for example, can be also performed as needed. The alloy of the present invention shows the highest performance in high-frequency applications, especially applications involving the passage of pulse current, and can also be used in applications of sensors and low-frequency magnetic parts. The alloy can show excellent properties particularly in applications where magnetic saturation is a problem, and is particularly suitable for applications of high-power power electronics.

A soft magnetic thin ribbon of the present invention, that is annealed while a magnetic field is applied in a direction almost perpendicular to the direction of magnetization when the thin ribbon is used, has a lower core loss than a conventional material having a high saturation magnetic flux density. Moreover, the soft magnetic thin ribbon of the present invention can provide excellent properties even if it is in the form of a thin film or a powder.

If magnetic parts are composed of the soft magnetic thin ribbon, high-performance or compact magnetic parts can be realized that are suitable for various reactors for high current such as anode reactors, choke coils for active filters, smoothing choke coils, various transformers, magnetic shields, noise suppression parts such as electromagnetic shielding materials, laser power supplies, pulse-power magnetic parts for accelerators, motors, generators or the like.

EXAMPLE 1

An alloy melt having each of the compositions shown in Table 1 was heated to 1300° C. and jet onto a Cu—Be alloy roll having an outer diameter of 300 mm and rotating at a peripheral speed of 30 m/s to produce an amorphous thin ribbon. The produced amorphous thin ribbons had a width of 5 mm and a thickness of about 21 μm. X-ray diffraction and transmission electron microscopy (TEM) showed that fine crystals of not greater than 30 nm were precipitated at not more than 1% in the amorphous phase. Each amorphous thin ribbon could be bent at 180 degrees and punched with a cutting tool such as a mold.

These amorphous thin ribbons were rapidly heated at an average heating rate of not less than 100° C./min in the temperature range of not lower than 300° C., held at 450° C. for 10 minutes, and then rapidly cooled to a room temperature. The heating rate was about 170° C./min at 350° C. The data on the coercive force and the maximum magnetic permeability of the soft magnetic thin ribbons subjected to the anneal are shown in Table 1. Each composition provides a $B_{8000}$ of not lower than 1.7 T. Although an alloy having a low Cu concentration tends to have a low nucleus number density, instantaneous heating thereof facilitated uniform formation of nucleus to reduce the residual amorphous phase and thus extended the range of compositions where $B_{8000}$ increased to not lower than 1.70 T. The present alloys have a high $B_{80}$ as well as a low $H_C$, and thus hold promise as soft magnetic materials. In each of these soft magnetic thin ribbons, at least a part of its structure contained crystalline grains having a grain size of not greater than 60 nm (excluding 0). In addition, the nano-crystalline grain phase in the amorphous phase had a volume fraction of not less than 50%.

TABLE 1

| Composition | Coercive force $H_c$ (A/m) | Magnetic flux density at 80 A/m $B_{80}$ (T) | Magnetic flux density at 8000 A/m $B_{8000}$ (T) | Maximum magnetic permeability $\mu_m$ ($10^3$) |
|---|---|---|---|---|
| $Fe_{bal.}Cu_{1.2}Si_5B_{11}P_2$ | 3.8 | 1.58 | 1.77 | 102 |
| $Fe_{bal.}Cu_{1.3}Si_5B_{11}P_2$ | 3.8 | 1.60 | 1.77 | 201 |
| $Fe_{bal.}Cu_{1.2}Si_3B_{11}P_4$ | 5.2 | 1.57 | 1.76 | 140 |
| $Fe_{bal.}Cu_{1.3}Si_3B_{11}P_4$ | 5.2 | 1.57 | 1.77 | 132 |
| $Fe_{bal.}Cu_{1.2}Si_3B_{13}P_2$ | 15.4 | 1.60 | 1.79 | 55 |
| $Fe_{bal.}Cu_{1.3}Si_3B_{13}P_2$ | 8.0 | 1.48 | 1.79 | 58 |
| $Fe_{bal.}Cu_{1.2}Si_2B_{12}P_2$ | 4.6 | 1.67 | 1.81 | 109 |
| $Fe_{bal.}Cu_{1.2}Si_3B_{12}P_2$ | 4.8 | 1.65 | 1.79 | 97 |
| $Fe_{bal.}Cu_{1.2}Si_4B_{12}P_2$ | 4.9 | 1.64 | 1.77 | 105 |
| $Fe_{bal.}Cu_{1.2}Si_5B_{12}P_2$ | 4.8 | 1.62 | 1.75 | 80 |
| $Fe_{bal.}Cu_{1.2}Si_6B_{12}P_2$ | 4.2 | 1.60 | 1.74 | 100 |
| $Fe_{bal.}Cu_{1.2}Si_1B_{13}P_2$ | 5.9 | 1.67 | 1.84 | 117 |
| $Fe_{bal.}Cu_{1.2}Si_2B_{13}P_2$ | 5.6 | 1.66 | 1.82 | 66 |
| $Fe_{bal.}Cu_{1.2}Si_5B_{13}P_2$ | 5.8 | 1.60 | 1.75 | 63 |
| $Fe_{bal.}Cu_{1.2}Si_8B_{13}P_2$ | 5.9 | 1.58 | 1.71 | 45 |
| $Fe_{bal.}Cu_{1.2}Si_7B_{13}P_2$ | 5.8 | 1.27 | 1.70 | 51 |
| $Fe_{bal.}Cu_{1.2}Si_1B_{14}P_2$ | 7.0 | 1.64 | 1.81 | 121 |
| $Fe_{bal.}Cu_{1.2}Si_4B_{14}P_2$ | 7.1 | 1.62 | 1.78 | 92 |
| $Fe_{bal.}Cu_{1.2}Si_2B_{14}P_2$ | 6.7 | 1.61 | 1.79 | 80 |
| $Fe_{bal.}Cu_{1.2}Si_3B_{14}P_2$ | 6.8 | 1.63 | 1.78 | 74 |
| $Fe_{bal.}Cu_{1.2}Si_6B_{14}P_2$ | 6.4 | 1.54 | 1.75 | 75 |
| $Fe_{bal.}Cu_{1.2}Si_1B_{15}P_2$ | 7.1 | 1.62 | 1.79 | 96 |
| $Fe_{bal.}Cu_{1.2}Si_2B_{15}P_2$ | 7.8 | 1.65 | 1.78 | 100 |
| $Fe_{bal.}Cu_{1.2}Si_3B_{15}P_2$ | 7.6 | 1.45 | 1.74 | 130 |
| $Fe_{bal.}Cu_{1.2}Si_4B_{15}P_2$ | 8.2 | 1.55 | 1.70 | 62 |
| $Fe_{bal.}Cu_{1.2}Si_1B_{16}P_2$ | 9.6 | 1.60 | 1.76 | 61 |
| $Fe_{bal.}Cu_{1.2}Si_3B_{16}P_2$ | 9.5 | 1.52 | 1.70 | 100 |
| $Fe_{bal.}Cu_{1.2}B_{13}P_2$ | 8.0 | 1.41 | 1.84 | 72 |
| $Fe_{bal.}Cu_{1.2}B_{14}P_2$ | 8.5 | 1.71 | 1.83 | 50 |
| $Fe_{bal.}Cu_{1.2}B_{15}P_2$ | 8.8 | 1.67 | 1.82 | 78 |
| $Fe_{bal.}Cu_{1.2}B_{16}P_2$ | 9.7 | 1.59 | 1.78 | 60 |
| $Fe_{bal.}Cu_{1.2}B_{18}P_2$ | 10.6 | 1.37 | 1.72 | 33 |
| $Fe_{bal.}Cu_{1.2}B_{20}P_2$ | 11.6 | 1.48 | 1.70 | 31 |
| $Fe_{bal.}Cu_{1.2}B_8P_{10}$ | 4.7 | 1.59 | 1.78 | 62 |
| $Fe_{bal.}Cu_{1.2}B_{10}P_8$ | 5.7 | 1.58 | 1.78 | 66 |
| $Fe_{bal.}Cu_{1.2}B_{13}P_5$ | 6.2 | 1.59 | 1.78 | 63 |
| $Fe_{bal.}Cu_{1.2}Si_2B_{10}P_6$ | 4.8 | 1.59 | 1.77 | 51 |
| $Fe_{bal.}Cu_{1.2}Si_2B_8P_8$ | 4.8 | 1.60 | 1.77 | 54 |
| $Fe_{bal.}Cu_{1.2}Si_2B_{10}P_8$ | 6.2 | 1.56 | 1.75 | 67 |
| $Fe_{bal.}Cu_{1.2}Si_2B_8P_{10}$ | 6.2 | 1.57 | 1.75 | 72 |
| $Fe_{bal.}Cu_{1.2}Si_3B_7P_8$ | 9.4 | 1.58 | 1.76 | 55 |
| $Fe_{bal.}Cu_{1.2}Si_3Bi_3P_{0.4}$ | 12.0 | 1.48 | 1.79 | 38 |

EXAMPLE 2

An alloy melt having each of the compositions shown in Table 2 was heated to 1300° C. and jet onto a Cu—Be alloy roll having an outer diameter of 300 mm and rotating at a peripheral speed of 30 m/s to produce an amorphous thin ribbon. The produced amorphous thin ribbons had a width of 5 mm and a thickness of about 21 μm. X-ray diffraction and transmission electron microscopy (TEM) showed that fine crystals were precipitated at not more than 1% in the amorphous phase. Each amorphous thin ribbon could be bent at 180 degrees and punched with a cutting tool such as a mold.

These plate-shaped samples were rapidly heated at an average heating rate of not less than 100° C./min in the temperature range of not lower than 300° C., held at 450° C. for 10 minutes, and then rapidly cooled to a room temperature. The heating rate was about 170° C./min at 350° C. The data on the coercive force and the maximum magnetic permeability of the samples are shown in Table 2. Each composition provides a $B_{8000}$ of not lower than 1.7 T. Although an alloy having a low Cu concentration tends to have a low nucleus, instantaneous heating facilitated uniform nucleation and reduced the residual amorphous phase and thus extended the range of compositions where $B_{8000}$ increased to not lower than 1.70 T.

The present soft magnetic thin ribbons have a high $B_{80}$ as well as a low $H_C$, and thus hold promise as soft magnetic materials.

In each of these soft magnetic thin ribbons, at least a part of its structure contained crystalline grains having a grain size of not greater than 60 nm (excluding 0). In addition, the nano-crystalline grain phase in the amorphous phase had a volume fraction of not less than 50%. It was proved that substitution with Nb decreases the average grain size of the nano-crystalline phase, to improve the saturation of the B—H curve, and to increase $B_{80}$.

TABLE 2

| Composition | Coercive force $H_c$ (A/m) | Magnetic flux density at 80 A/m $B_{80}$ (T) | Magnetic flux density at 8000 A/m $B_{8000}$ (T) | Maximum magnetic permeability $\mu_m$ ($10^3$) |
|---|---|---|---|---|
| $Fe_{bal.}Cu_{1.0}Nb_{1.0}Si_2B_{12}P_2$ | 3.0 | 1.70 | 1.75 | 185 |
| $Fe_{bal.}Cu_{1.2}Nb_{1.0}Si_2B_{12}P_2$ | 4.6 | 1.71 | 1.75 | 134 |
| $Fe_{bal.}Cu_{1.0}Nb_{1.0}Si_2B_{10}P_2$ | 6.8 | 1.71 | 1.79 | 59 |
| $Fe_{bal.}Cu_{1.0}Nb_{1.0}Si_4B_{10}P_2$ | 3.3 | 1.63 | 1.75 | 65 |

EXAMPLE 3

An alloy melt having each of the compositions shown in Table 3 was heated to 1300° C. and jet onto a Cu—Be alloy roll having an outer diameter of 300 mm rotating at a peripheral speed of 30 m/s to produce an amorphous thin ribbon. The produced amorphous thin ribbons had a width of 5 mm and a thickness of about 21 μm. X-ray diffraction and transmission electron microscopy (TEM) showed that fine crystals of not greater than 30 nm were precipitated at not more than 1% in the amorphous phase. Each amorphous thin ribbon could be bent at 180 degrees and punched with a cutting tool such as a mold.

These plate-shaped samples were rapidly heated at an average heating rate of not less than 100° C./min in the temperature range of not lower than 300° C., held at 450° C. for 10 minutes, and then rapidly cooled to a room temperature. The heating rate was about 170° C./min at 350° C. The data on the coercive force $H_C$ and the saturation magnetic flux density $B_S$ (the value of $B_{8000}$ is assumed to be Bs) of the alloys are shown in Table 3. Each composition provides a $B_S$ of not lower than 1.7 T. Although an alloy having a low Cu concentration tends to have a low nucleus, instantaneous heating facilitates uniform nucleation. The present alloys have a low $H_C$ at 10 A/m and hold promise as soft magnetic materials having a high $B_S$ and a low loss.

In each of these soft magnetic thin ribbons, at least a part of its structure contained crystalline grains having a grain size of not greater than 60 nm (excluding 0). In addition, the nano-crystalline grain phase in the amorphous phase had a volume fraction of not less than 50%.

TABLE 3

| Composition (at %) | $B_s$ (T) | Coercive force $H_c$ (A/m) |
|---|---|---|
| $Fe_{bal.}Cu_{0.8}Au_{0.2}Si_1B_{13}P_2$ | 1.84 | 5.2 |
| $Fe_{bal.}Ni_2Cu_{1.2}Si_2Bi_{12}P_2$ | 1.81 | 4.5 |
| $Fe_{bal.}Co_2Cu_{1.2}Si_2B_{12}P_2$ | 1.82 | 6.8 |
| $Fe_{bal.}Cu_{1.2}Si_3B_{12}P_2Al_{0.5}$ | 1.80 | 3.5 |
| $Fe_{bal.}Cu_{1.2}Si_3B_{12}P_2Ge_{0.5}$ | 1.80 | 6.9 |
| $Fe_{bal.}Cu_{1.2}Si_3B_{12}P_2C_{0.5}$ | 1.80 | 4.5 |

TABLE 3-continued

| Composition (at %) | $B_s$ (T) | Coercive force $H_c$ (A/m) |
|---|---|---|
| $Fe_{bal.}Cu_{1.2}Au_{0.5}Si_3B_{12}P_2$ | 1.81 | 4.0 |
| $Fe_{bal.}Cu_{1.2}Si_3B_{12}P_2Pt_{0.5}$ | 1.81 | 4.1 |
| $Fe_{bal.}Cu_{1.2}Si_3B_{12}P_2W_{0.5}$ | 1.79 | 7.2 |
| $Fe_{bal.}Cu_{1.2}Si_3B_{12}P_2Sn_{0.5}$ | 1.80 | 7.2 |
| $Fe_{bal.}Cu_{1.2}Si_3B_{12}P_2In_{0.5}$ | 1.80 | 7.3 |
| $Fe_{bal.}Cu_{1.2}Si_3B_{12}P_2Ga_{0.5}$ | 1.81 | 7.1 |
| $Fe_{bal.}Cu_{1.2}Si_3B_{12}P_2Ti_{0.5}$ | 1.81 | 7.8 |
| $Fe_{bal.}Cu_{1.2}Si_3B_{12}P_2Cr_{0.5}$ | 1.80 | 8.0 |
| $Fe_{bal.}Cu_{1.2}Si_3B_{12}P_2Hf_{0.5}$ | 1.78 | 6.2 |
| $Fe_{bal.}Cu_{1.2}Si_3B_{12}P_2Nb_{0.5}$ | 1.78 | 6.9 |
| $Fe_{bal.}Cu_{1.2}Si_3B_{12}P_2Zr_{0.5}$ | 1.78 | 7.0 |
| $Fe_{bal.}Cu_{1.2}Si_3B_{12}P_2Ta_{0.5}$ | 1.78 | 7.0 |
| $Fe_{bal.}Cu_{1.2}Si_3B_{12}P_2Mo_{0.5}$ | 1.78 | 7.1 |
| $Fe_{bal.}Cu_{1.2}Si_3B_{12}P_2Ge_{0.5}$ | 1.80 | 8.2 |
| $Fe_{bal.}Cu_{1.2}Si_3B_{12}P_2Mn_{0.5}$ | 1.80 | 4.2 |
| $Fe_{bal.}Cu_{1.4}Nb_{0.025}Si_1B_{12}P_2$ | 1.85 | 8.8 |
| $Fe_{bal.}Cu_{1.2}V_{0.2}Si_{14}B_7P_2$ | 1.76 | 7.8 |
| $Fe_{bal.}Cu_{1.2}Si_4B_{12}P_2Zr_{0.2}$ | 1.81 | 6.5 |

EXAMPLE 4

An alloy melt having each of the compositions shown in Table 4 was heated to 1300° C. and jet onto a Cu—Be alloy roll having an outer diameter of 300 mm and rotating at a peripheral speed of 30 m/s to produce an amorphous thin ribbon having a width of 5 mm and a thickness of about 27 μm. The amorphous thin ribbon of the present invention to which P was added could be bent at 180 degrees. In addition, the X-ray diffraction and transmission electron microscopy (TEM) of the amorphous thin ribbon of the present invention showed that fine crystals of not greater than 30 nm were precipitated in the amorphous phase at not more than 1%.

These samples were rapidly heated at an average heating rate of not less than 100° C./min in the temperature range of not lower than 300° C., held at 450° C. for 10 minutes, and then rapidly cooled to room temperature. The heating rate was about 170° C./min at 350° C. The data on the plate thickness, coercive force, saturation magnetic flux density, precipitation of crystalline grains upon production of the samples are shown in Table 4. For the amorphous thin ribbon containing P according to the present invention, almost no precipitated crystalline grains are found in the amorphous soft magnetic thin ribbon, even if it is thick, and a uniform amorphous phase can be obtained. The thin ribbon can also be bent at 180 degrees. When the thin ribbon is annealed, an increase in $H_C$ is inhibited even if the thickness is increased. Although the thin ribbon has a thickness of 27 μm, an $H_C$ of about 6 A/m, which is much lower than 10 A/m, is obtained. As a result, stable and good soft magnetic properties are obtained in a wide range of thickness.

In a Comparative Example to which P is not added, crystalline grains are remarkably precipitated when the thickness is increased, and the thin ribbon cannot easily be bent at 180 degrees. Anneal of the thin ribbon increases the coercive force $H_C$ to 14 A/m.

TABLE 4

| | Composition | Thickness (mm) | $H_c$ (A/m) | $B_s$ (T) | Volume fraction of crystalline grains |
|---|---|---|---|---|---|
| Present invention | $Fe_{bal.}Cu_{1.0}Nb_{1.0}Si_2B_{12}P_2$ | 27 | 6.1 | 1.78 | not more than 1% |
| Comparative Example | $Fe_{bal.}Cu_{1.0}Nb_{1.0}Si_4B_{12}$ | 27 | 14.2 | 1.79 | not less than 10% |

EXAMPLE 5

An alloy melt having each of the compositions shown in Table 5 was heated to 1300° C. and jet onto a Cu—Be alloy roll having an outer diameter of 300 mm rotating at a peripheral speed of 30 m/s to produce an amorphous thin ribbon having a width of 5 mm and a thickness of about 20 μm. The amorphous thin ribbons of the present invention to which P was added could be bent 180 degrees. In addition, the X-ray diffraction and transmission electron microscopy (TEM) of the amorphous thin ribbons of the present invention showed that fine crystals of not greater than 30 nm were precipitated in the amorphous phase at not more than 1%.

These samples were rapidly heated at an average heating rate of not less than 100° C./min in the temperature range of not lower than 300° C., held at 420° C. for 5 minutes, and then rapidly cooled to room temperature. The heating rate was about 180° C./min at 350° C. The data on the plate thickness, coercive force, saturation magnetic flux density, and precipitation of crystalline grains upon production of the samples are shown in Table 5. For the amorphous thin ribbons containing P according to the present invention, almost no precipitated crystalline grains are found in the amorphous soft magnetic thin ribbons even if it is thick, and a uniform amorphous phase can be obtained. Moreover, substitution with Ni, that solid solutes with Fe and Cu, facilitates high-density Cu clustering to form a fine nano-crystalline phase, thereby a low coercive force $H_C$ is obtained. Thus, the soft magnetic properties are improved.

TABLE 5

| Composition | Coercive force $H_c$ (A/m) | Magnetic flux density at 80 A/m $B_{80}$ (T) | Magnetic flux density at 8000 A/m $B_{8000}$ (T) | Maximum magnetic permeability $\mu_m$ ($10^3$) |
|---|---|---|---|---|
| $Fe_{bal.}Cu_{1.2}Si_4B_{10}P_2$ | 4.8 | 1.57 | 1.81 | 69 |
| $Fe_{bal.}Ni_2Cu_{1.2}Si_4B_{10}P_2$ | 3.4 | 1.46 | 1.78 | 72 |
| $Fe_{bal.}Ni_2Cu_{1.0}Si_2B_{12}P_2$ | 7.5 | 1.50 | 1.78 | 39 |
| $Fe_{bal.}Ni_2Cu_{1.2}Si_2B_{12}P_2$ | 4.5 | 1.55 | 1.81 | 62 |

Table 6 shows the soft magnetic properties and iron loss of a sample obtained by rapidly annealing a ring-shaped core having φ19×φ15×5 mm made from the $Fe_{bal.}Cu_{1.0}Nb_{1.0}Si_2B_{12}P_2$ alloy. Extremely good iron loss properties can be obtained in the range of frequency greater than the commercial frequency.

The invention claimed is:

1. A method for producing a soft magnetic thin ribbon, comprising the steps of:

casting an alloy melt into a shape of an amorphous thin ribbon having a thickness of not greater than 100 μm, the alloy having a composition represented by a formula: $Fe_{100-x-y-z}A_xM_yX_{z-a}P_a$, where A represents at least one element selected from Cu and Au; M represents at least one element selected from Ti, Zr, Hf, V, Nb, Ta, Cr, Mo and W; X represents B and Si; and $0.7 \leqq x \leqq 1.3$, $0 \leqq y \leqq 2.5$, $10 \leqq z \leqq 23$, and $2 \leqq a \leqq 10$ in atomic percent, the alloy including crystalline grains having a size of not greater than 30 nm precipitated in a volume fraction of not more than 1%, including 0%, in an amorphous phase, and the amorphous thin ribbon being able to be bent at 180 degrees;

working the amorphous thin ribbon with a cutting tool; and then annealing the amorphous thin ribbon at an average heating rate of not less than 100° C./min in a temperature range from 300° C. to an annealing temperature, the annealing temperature being higher than a crystallization temperature, to obtain a soft magnetic thin ribbon having a structure where crystalline grains having a grain size of not greater than 60 nm (excluding 0) are dispersed at a volume fraction of not less than 30% in an amorphous phase.

2. The method according to claim 1, wherein the value of the y is zero.

3. An amorphous thin ribbon having a composition represented by a formula: $Fe_{100-x-y-z}A_xM_yX_{z-a}P_a$, where A represents at least one element selected from Cu and Au; M represents at least one element selected from Ti, Zr, Hf, V, Nb, Ta, Cr, Mo and W; X represents B and Si; and $0.7 \leqq x \leqq 1.3$, $0 \leqq y \leqq 2.5$, $10 \leqq z \leqq 23$, and $2 \leqq a \leqq 10$ in atomic percent, the amorphous thin ribbon including crystalline grains having a size of not greater than 30 nm precipitated in a volume fraction of not more than 1%, including 0%, in an amorphous phase, the amorphous thin ribbon being be able to be bent at 180 degrees, and the amorphous thin ribbon being able to be worked by a cutting tool.

4. The amorphous thin ribbon according to claim 3, wherein the value of the y is zero.

5. The amorphous thin ribbon according to claim 3, wherein a part of Fe is replaced by at least one element selected from Ni and Co in an amount of less than 10 at %; and/or,

TABLE 6

| Composition | Coercive force $H_c$ (A/m) | Magnetic flux density at 80 A/m $B_{80}$ (T) | Magnetic flux density at 800 A/m $B_{800}$ (T) | Iron loss at 50 Hz and 1.5 T $P_{15/50}$ (W/kg) | Iron loss at 400 Hz and 1.0 T $P_{10/400}$ (W/kg) | Iron loss at 1 kHz and 1.0 T $P_{10/1k}$ (W/kg) |
|---|---|---|---|---|---|---|
| $Fe_{bal.}Cu_{1.0}Nb_{1.0}Si_2B_{12}P_2$ | 8.0 | 1.69 | 1.76 | 0.25 | 0.9 | 2.4 |

a part of Fe is replaced by at least one element selected from Re, the platinum group elements, Ag, Zn, In, Sn, As, Sb, Bi, Y, N, O, Mn and the rare earth elements in an amount of less than 5 at % relative to the Fe content.

6. The amorphous thin ribbon according to claim 3, wherein a part of the X element is replaced by at least one element selected from Be, Ga, Ge, C and Al in an amount of less than 5 at %.

7. A soft magnetic thin ribbon obtained by annealing the amorphous thin ribbon according to claim 3 at an average heating rate of not less than 100° C./min in a temperature range from 300° C. to an annealing temperature, the annealing temperature being higher than the crystallization temperature, the soft magnetic thin ribbon comprising a structure where a body-centered cubic structural crystalline grains having an average grain size of not greater than 60 nm are dispersed at a volume fraction of not less than 30% in an amorphous phase.

8. The soft magnetic thin ribbon according to claim 7, having a saturation magnetic flux density of not lower than 1.7 T and a coercive force of not higher than 20 A/m.

9. A magnetic part comprising the soft magnetic thin ribbon according to claim 7.

10. The method according to claim 1, wherein the heat-treating step includes holding the amorphous thin ribbon at the annealing temperature for not shorter than 1 second but not longer than 30 minutes.

11. The method according to claim 1, wherein the value of a is from 4 to 10.

12. The amorphous thin ribbon according to claim 3, wherein the value of a is from 4 to 10.

* * * * *